US007018215B2

(12) United States Patent
Williams et al.

(10) Patent No.: US 7,018,215 B2
(45) Date of Patent: Mar. 28, 2006

(54) ROUTING SYSTEM

(75) Inventors: Gary W. Williams, Rowlett, TX (US); Brent A. Boudreaux, Highland Village, TX (US); Shaun L. Harris, McKinney, TX (US); Paul A. Wirtzberger, Greenville, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/741,577

(22) Filed: Dec. 19, 2003

(65) Prior Publication Data

US 2005/0136728 A1 Jun. 23, 2005

(51) Int. Cl.
*H01R 12/00* (2006.01)

(52) U.S. Cl. ..... 439/61

(58) Field of Classification Search ..... 439/61, 439/719, 301, 501; 361/728–770, 796–798, 361/825–830
See application file for complete search history.

(56) References Cited

U.S. PATENT DOCUMENTS 2,896,009 A * 7/1959 Caveney ..... 174/72 A
6,545,611 B1 * 4/2003 Hayashi et al. ..... 340/686.4

* cited by examiner

*Primary Examiner*—Phuong Dinh

(57) ABSTRACT

Embodiments of a routing system for electronic module assemblies are disclosed that may incorporate a module base having at least one routing end and a channel formed across a length of the at least one routing end, wherein the channel has a dimension that allows a wire to be routed from the module base to a connection point external to the module base and allows the wire to be bent within the channel in a direction of the connection point.

12 Claims, 4 Drawing Sheets

ROUTING SYSTEM

BACKGROUND

As functional requirements continue to push modular electrical and mechanical system designs into smaller packages having more features, an issue has arisen with wire routing. Modular design constraints generally provide that the input wire routing exit from one end of the module due, in part, to the side-by-side module mounting specifications. A wire exit path should generally be capable of routing to either side during module installation at the next higher assembly. In some cases, a wire exit path provides a distance of only two millimeters or less between the module and the system wall. Such a small distance is typically insufficient to safely route wiring, such as input power wiring and the like.

SUMMARY

Representative embodiments of the present invention are related to a routing system for electronic module assemblies that may incorporate a module base having at least one routing end and a channel formed across a length of the at least one routing end, wherein the channel has a dimension that allows a wire to be routed from the module base to a connection point external to the module base and allows the wire to be bent within the channel in a direction of the connection point.

Additional representative embodiments of the present invention are related to a method for routing a conductor from an electronic module that may incorporate connecting the conductor to a module connection point and placing the conductor into a routing slot along a wire exit end of the electronic module.

Further representative embodiments of the present invention are related to an electronic module assembly that may incorporate a plurality of modules connected into a backbone of the electronic module assembly, a plurality of connection pads external to the plurality of modules, a routing channel formed into at least one routing end of each of the plurality of modules, and a plurality of conductors for connecting each of the plurality of modules to selected ones of the plurality of connection pads, wherein the plurality of conductors are routed from the plurality of modules through the routing channels.

BRIEF DESCRIPTION OF THE DRAWINGS

For a more complete understanding of the present invention, reference is now made to the following descriptions taken in conjunction with the accompanying drawing, in which.

DETAILED DESCRIPTION

Figure 1:
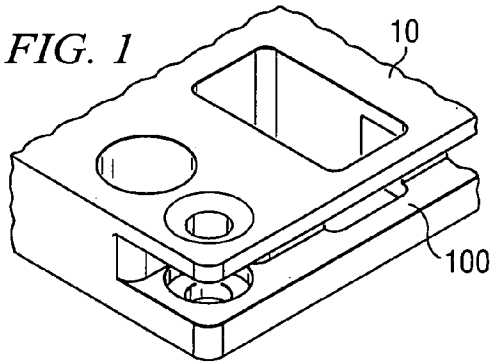
FIG. 1 is a diagram illustrating a portion of a module base configured according to an embodiment of the present wire routing system.

FIG. 1 is a diagram illustrating a portion of module base 10 configured according to an embodiment of the present wire routing system. Module base 10 includes routing slot 100 positioned at one or both of routing ends 203 and 204 (FIG. 2) of module base 10. Because routing slot 100 is formed into routing ends 203 and 204 (FIG. 2) of module base 10, no additional space requirements arise for the wire routing. Moreover, because routing slot 100 runs the length of routing ends 203 and 204 (FIG. 2), it may accommodate input routing from the left or right-hand sides.

Figure 2:
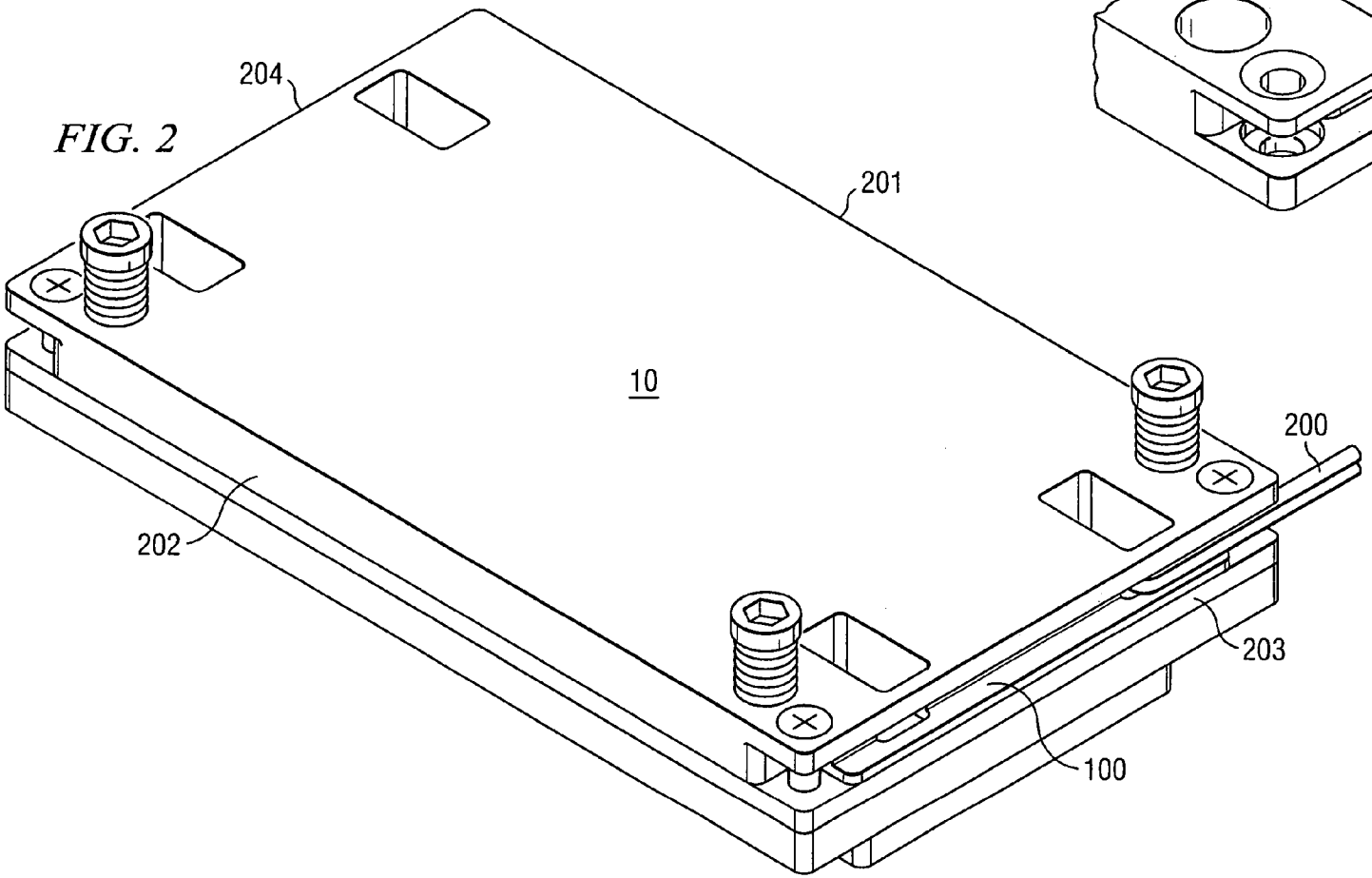
FIG. 2 is a diagram illustrating a module base constructed into an exemplary left-hand routing configuration.

FIG. 2 is a diagram illustrating module base 10 constructed into an exemplary left-hand routing configuration. According to the teachings expressed herein, input power wire 200 feeds into module base 10 from the left-hand side of module base 10. The extra space provided for by routing slot 100 allows input power wire 200 to exit module base 10 and bend to the left without interference from the system wall of the system to which module base 10 will be connected. In operation, routing end 203 may be situated within a few millimeters of the system wall. Channel 100, therefore, allows input power wire 200 to freely move within the system. Typically, module base 10 has a system connector on one of sides 201 and/or 202. Module base 10 may then be plugged into a system at side 201 or side 202.

Figure 3:
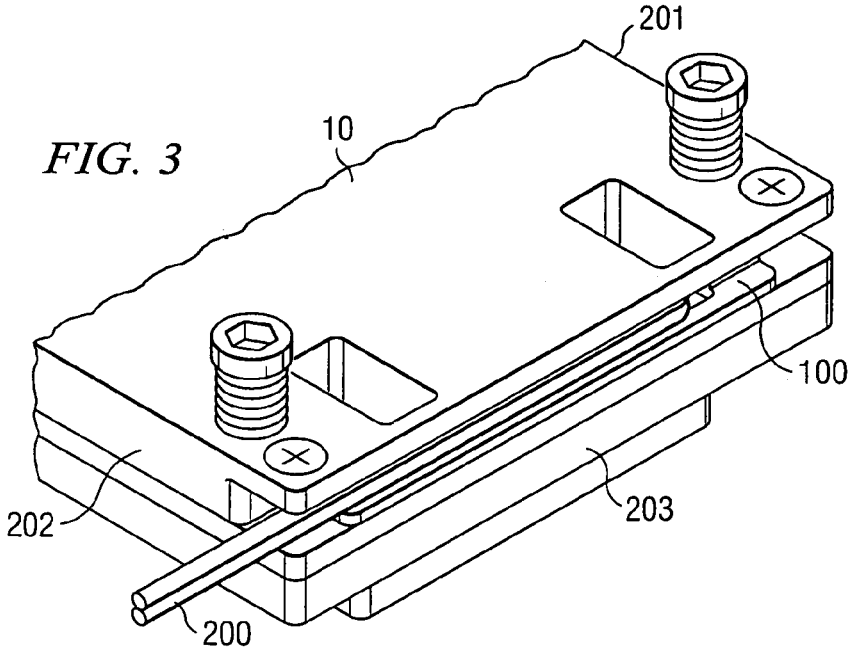
FIG. 3 is a diagram illustrating a portion of a module base constructed into an exemplary right-handed routing configuration.

FIG. 3 is a diagram illustrating a portion of module base 10 constructed into an exemplary right-handed routing configuration. Similar to the operation of the left-handed routing configuration depicted in FIG. 2, the right-handed routing configuration allows input power conductor 200 to be routed to the right side of module base 10. Routing slot 100 is constructed to a depth and width that will allow the gauge of input power conductor 200 to be bent and directed across the width of the wire exit end of module base 10. Routing slot 100, therefore, provides a channel for input power conductor 200 to exit module base 10.

Figure 4:
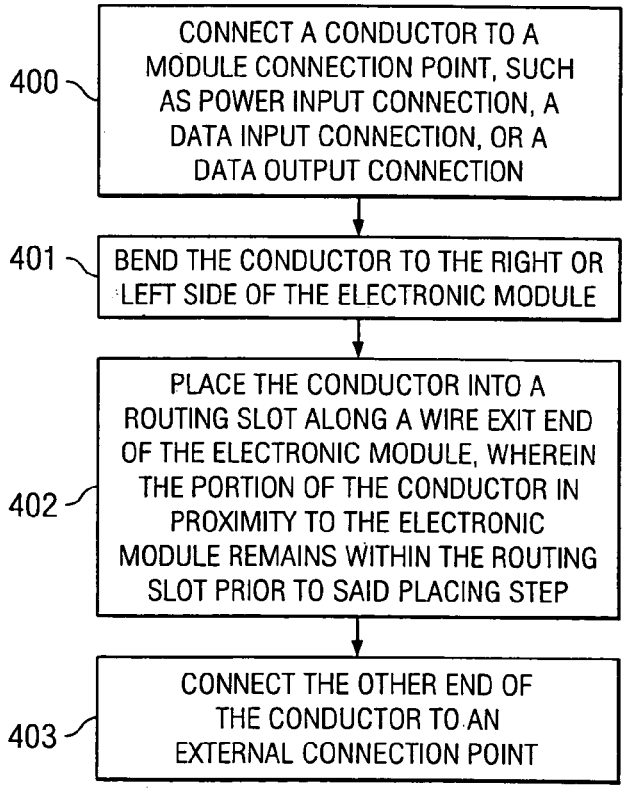
FIG. 4 is a flow chart illustrating steps performed in an embodiment of the present wire routing system.

FIG. 4 is a flow chart illustrating steps performed in an embodiment of the present wire routing system. In step 400, a conductor is connected to a module connection point, such as a power input connection, a data input connection, a data output connection, or the like. The conductor is bent either to the right or left side of the electronic module in step 401. In step 402, the conductor is placed into a routing slot along a wire exit end of the electronic module, wherein the portion of the conductor in proximity to the electronic module remains within the routing slot prior to said placing step. In step 403, the other end of the conductor is connected to an external connection point.

Figure 5:
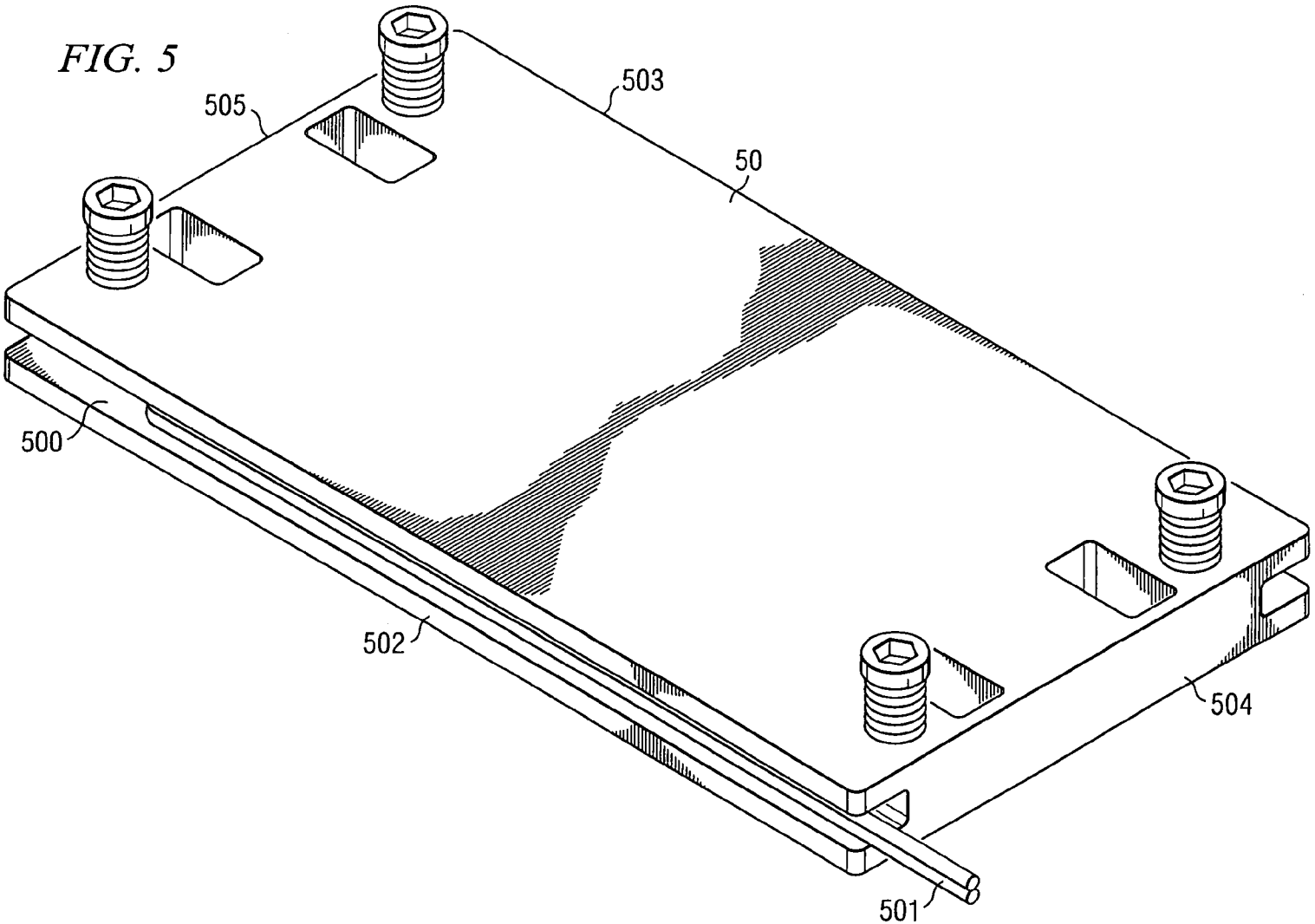
FIG. 5 is a diagram illustrating a module base constructed into an exemplary configuration having a routing slot constructed in the side of the module base.

FIG. 5 is a diagram illustrating module base 50 constructed into an exemplary configuration having routing slot 500 constructed in the side of module base 50. According to the teachings expressed herein, input power wire 501 feeds into module base 50 from side 502. Similarly, a routing slot similar to routing slot 500 may exist in side 503 to accommodate wire routing from side 503. The extra space provided for by routing slot 500 allows input power wire 501 to exit module base 50 and bend to the left without interference from the system wall of the system to which module base 50 will be connected. In operation, module base 50 may be connected into the overall system at connection ends 504 and 506. Routing slot 500 in side 502 and the other routing slot in side 503, therefore, allow the wire routing to and from module base 50.

Figure 6:
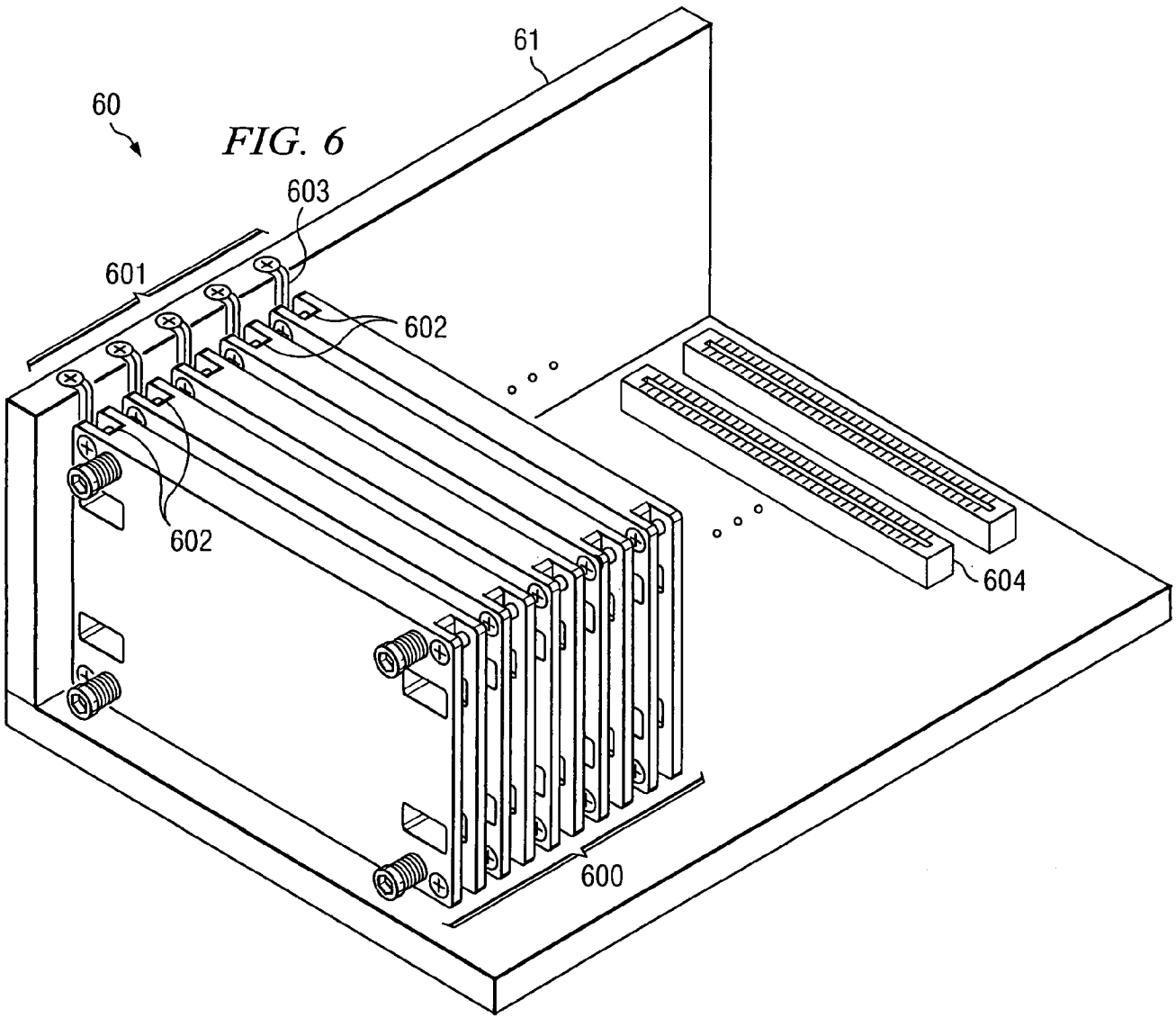
FIG. 6 is a diagram illustrating a plurality of modules configured according to one embodiment of the present invention connected to an assembly backbone.

In operation, several modules are placed in an electronic module assembly as a part of the electronic system. FIG. 6 is a diagram illustrating a plurality of modules 600 configured according to one embodiment of the routing system described herein connected to assembly backplane 61. Backplane 61 is an interconnecting device that may or may not have intelligence or processing, but that typically has connection sockets 604 into which computer boards or modules 600 may be connected. Backplane 61 includes a number of connection pads 601 that facilitate connection between modules 600 and system 60. Conductors 603 are routed through routing channels 602 in modules 600 to connection pads 601 for supplying, for example, power to modules 600 in selected embodiments.

What is claimed is:

1. A routing system for electronic module assemblies comprising:

a module base having at least one routing end; and a channel formed across a length of said at least one routing end, wherein said channel has a dimension that allows a wire to be routed from said module base to a connection point on a backplane into which said module base is installed, and wherein said channel allows said wire to be bent within said channel in a direction of said connection point.

2. The routing system of claim 1 wherein said wire is routed to one of:

a left side of said module base; and a right side of said module base.

3. The routing system of claim 1 wherein said wire provides one of:

input power; and output data.

4. A method for routing a conductor from an electronic module to an electronic system, said method comprising:

connecting said conductor to a module connection point;

placing said conductor into a routing slot along a wire exit end of said electronic module; and installing said electronic module into said electronic system.

5. The method of claim 4 further comprising:

bending said conductor within said routing slot prior to said placing step.

6. The method of claim 5 wherein said bending comprises one of:

bending to a right side of said electronic module; and bending to a left side of said electronic module.

7. The method of claim 4 wherein said module connection point comprises one of:

a power input connection;

a data input connection; and a data output connection.

8. The method of claim 4 further comprising:

connecting said conductor to an external connection point.

9. An electronic module assembly comprising:

a plurality of modules connected into a backbone of said electronic module assembly;

a plurality of connection pads external to said plurality of modules;

a routing channel formed into at least one routing end of each of said plurality of modules; and a plurality of conductors for connecting each of said plurality of modules to selected ones of said plurality of connection pads, wherein said plurality of conductors are routed from said plurality of modules through said routing channels.

10. The electronic module assembly of claim 9 wherein said plurality of connection pads are located at one or more of:

a left-hand side of said plurality of modules; and a right-hand side of said plurality of modules.

11. The electronic module assembly of claim 9 wherein a portion of said conductors routed through said routing channel remains within a dimension of said routing channel.

12. The electronic module assembly of claim 9 wherein each of said modules is connected side-by-side on said backbone.

* * * * *